US010397707B2

(12) United States Patent
Yokoi et al.

(10) Patent No.: US 10,397,707 B2
(45) Date of Patent: Aug. 27, 2019

(54) PIEZOELECTRIC SOUNDING COMPONENT

(71) Applicant: Murata Manufacturing Co., Ltd., Nagaokakyo-shi, Kyoto-fu (JP)

(72) Inventors: Yuko Yokoi, Nagaokakyo (JP); Masakazu Yamauchi, Nagaokakyo (JP); Junichi Murakami, Nagaokakyo (JP); Kazuchika Yamada, Nagaokakyo (JP); Takaaki Kaji, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 0 days.

(21) Appl. No.: 15/982,340

(22) Filed: May 17, 2018

(65) Prior Publication Data

US 2018/0270583 A1 Sep. 20, 2018

Related U.S. Application Data

(63) Continuation of application No. PCT/JP2017/020311, filed on May 31, 2017.

(30) Foreign Application Priority Data

Sep. 28, 2016 (JP) ..... 2016-189743

(51) Int. Cl.
*H04R 17/00* (2006.01)
*G10K 9/122* (2006.01)
(Continued)

(52) U.S. Cl.
CPC ..... *H04R 17/00* (2013.01); *B06B 1/0666* (2013.01); *G10K 9/122* (2013.01); *G10K 9/22* (2013.01);
(Continued)

(58) Field of Classification Search
CPC ..... H04R 17/00; H04R 1/06; H04R 17/02; H04R 1/288; H04R 2307/023;
(Continued)

(56) References Cited

U.S. PATENT DOCUMENTS 6,445,108 B1 * 9/2002 Takeshima ..... B06B 1/0603 310/322
6,570,299 B2 5/2003 Takeshima et al.
(Continued)

FOREIGN PATENT DOCUMENTS

JP 20039286 A 1/2003
JP 2004312323 A 11/2004

OTHER PUBLICATIONS

International Search Report issued in PCT/JP2017/020311, dated Aug. 8, 2017.
(Continued)

*Primary Examiner* — Curtis A Kuntz
*Assistant Examiner* — Julie X Dang
(74) *Attorney, Agent, or Firm* — Arent Fox LLP

(57) ABSTRACT

A piezoelectric sounding component includes a diaphragm that includes a metal plate and a piezoelectric body formed on the metal plate. The diaphragm bends and vibrates according to application of voltage to the piezoelectric body. A casing includes a bottom wall, side walls which, in combination with the diaphragm define a sound chamber. The diaphragm is supported by a support portion formed in the casing such that outer peripheral edges of the diaphragm are spaced from inner surfaces of the casing. A terminal is located on the casing and is electrically connected to the diaphragm. At least two elastic adhesives join the diaphragm to the casing and respective conductive adhesives extend over its associated elastic adhesive from the diaphragm to a respective terminal. A frame-like sealing portion seals a gap
(Continued)

between the outer peripheral edge of the diaphragm and the inner surfaces of the casing. A recessed portion is formed in a portion of the support portion facing the terminal such that the first elastic adhesive extends over the recessed portion.

17 Claims, 6 Drawing Sheets

(51) Int. Cl.

| | |
|---|---|
| ***H04R 1/02*** | (2006.01) |
| ***G10K 9/22*** | (2006.01) |
| ***B06B 1/06*** | (2006.01) |
| ***H04R 31/00*** | (2006.01) |

(52) U.S. Cl.
CPC ..... *H04R 1/02* (2013.01); *H04R 17/005* (2013.01); *H04R 31/006* (2013.01); *H04R 2201/02* (2013.01)

(58) Field of Classification Search
CPC .. H04R 31/003; H04R 31/006; B06B 1/0603; B06B 1/06; B06B 1/0607; B06B 1/0618; G10K 9/125; G01R 15/20; G01R 15/207; G01R 19/0092; G01R 33/07; G01R 33/09
USPC ..... 381/190, 150, 173, 310; 310/348, 324, 310/320, 340, 344
See application file for complete search history.

(56) References Cited

U.S. PATENT DOCUMENTS

| | | | | |
|---|---|---|---|---|
| 6,960,868 | B2 | 11/2005 | Ishimasa et al. | |
| 2002/0195901 | A1 | 12/2002 | Takeshima et al. | |
| 2004/0124748 | A1* | 7/2004 | Takeshima ..... | H04R 17/00 310/331 |
| 2004/0195941 | A1 | 10/2004 | Ishimasa et al. | |

OTHER PUBLICATIONS

Written Opinion of the International Searching Authority issued in PCT/JP2017/020311, dated Aug. 8, 2017.

* cited by examiner

PIEZOELECTRIC SOUNDING COMPONENT

CROSS REFERENCE TO RELATED APPLICATIONS

The present application is a continuation of International application No. PCT/JP2017/020311, filed May 31, 2017, which claims priority to Japanese Patent Application No. 2016-189743, filed Sep. 28, 2016, the entire contents of each of which are incorporated herein by reference.

BACKGROUND OF THE INVENTION

The present invention relates to piezoelectric sounding components.

In conventional electronic equipment, such as cellular phones and household appliances, piezoelectric sounding components that produce warning sounds and operation sounds, such as piezoelectric speakers and piezoelectric sounders, are widely used.

For example, Japanese Unexamined Patent Application Publication No. 2003-9286 discloses such a piezoelectric sounding component. The piezoelectric sounding component described in Japanese Unexamined Patent Application Publication No. 2003-9286 has a structure where a piezoelectric sounding body (diaphragm), constituted of a piezoelectric element and a metal plate, is accommodated in a casing. The diaphragm is fixed to the casing with an elastic adhesive. A conductive adhesive, which extends over the elastic adhesive, electrically connects the diaphragm to the piezoelectric element.

In the foregoing piezoelectric sounding component, the elastic adhesive is coated on a support portion that is formed in a casing and supports the diaphragm. When the elastic adhesive is placed on the support portion a bubble is sometimes formed between the support portion and the diaphragm and is confined by the elastic adhesive. During a heating or similar process, the bubble can expand and deform the elastic adhesive (e.g., raise the upper surface of the elastic adhesive). Accordingly, when a conductive adhesive is coated on the elastic adhesive the shape of the conductive adhesive becomes unstable and the risk of causing a break in the conductive adhesive increases.

BRIEF DESCRIPTION OF THE INVENTION

The present invention has been made in view of such circumstances and one of the objects of the present invention is to provide a piezoelectric sounding component with high reliability.

A piezoelectric sounding component in accordance with one aspect of the present invention includes a diaphragm which vibrates in response to an electric signal applied thereto and a casing having a sound chamber having an open end. A support portion of the casing supports the diaphragm at a location within the casing such that the diaphragm closes the open end of the sound chamber. The diaphragm is supported by the support portion such that there is a gap between outer peripheral edges of the diaphragm and inner surfaces of the casing. First and second terminals are located on casing. First and second elastic adhesives join the diaphragm to the casing at locations corresponding to the first and second terminals, respectively. First and second conductive adhesives extend over the first and second elastic adhesives, respectively, and electrically connecting the diaphragm to the first and second terminals, respectively. A frame-like sealing portion seals the gap between outer peripheral edges of the diaphragm and inner surfaces of the casing. The support portion includes a recessed portion, at least part of which is located immediately below the first elastic adhesive.

Because of the presence of the recessed portion, a bubble of fluid can be located between the recessed portion and a bottom surface of the first elastic adhesive.

In a preferred embodiment, the recessed portion is a groove that is formed at a location corresponding to the first terminal. The groove preferably faces the first terminal. The first elastic adhesive, the first conductive adhesive, and the sealing portion are preferably located one on top of the other in that order.

The diaphragm preferably includes a metal plate and a piezoelectric body coupled to the metal plate. The frame-like sealing portion preferably includes a sealing portion covering the gap between the outer peripheral edges of the diaphragm and inner surfaces of the casing. The frame-like sealing portion also preferably includes a portion covering the piezoelectric body.

In the preferred embodiment, the casing includes a bottom wall and a plurality of side walls extending upwardly from the bottom wall. The inner surfaces of the bottom wall and the plurality of side walls cooperate to define the sound chamber.

In the preferred embodiment, the support portion is defined by top surfaces of the side walls and the sound chamber takes the form of a rectangular parallelepiped.

In a preferred embodiment, the recessed portion includes portions extending into the sound chamber so there is fluid communication between the recessed portion and the sound chamber.

In a preferred embodiment, the casing further includes an upwardly projecting portion located between the first terminal and the recessed portion and extending above both the recessed portion and the first terminal.

In a preferred embodiment, the piezoelectric sounding component further comprises a second recessed portion, at least part of which is located immediately below the second elastic adhesive. The present invention can provide a piezoelectric sounding component with high reliability.

DESCRIPTION OF THE EMBODIMENTS

Embodiments of the present invention are described below by referring to the accompanying drawings.

Figure 1:
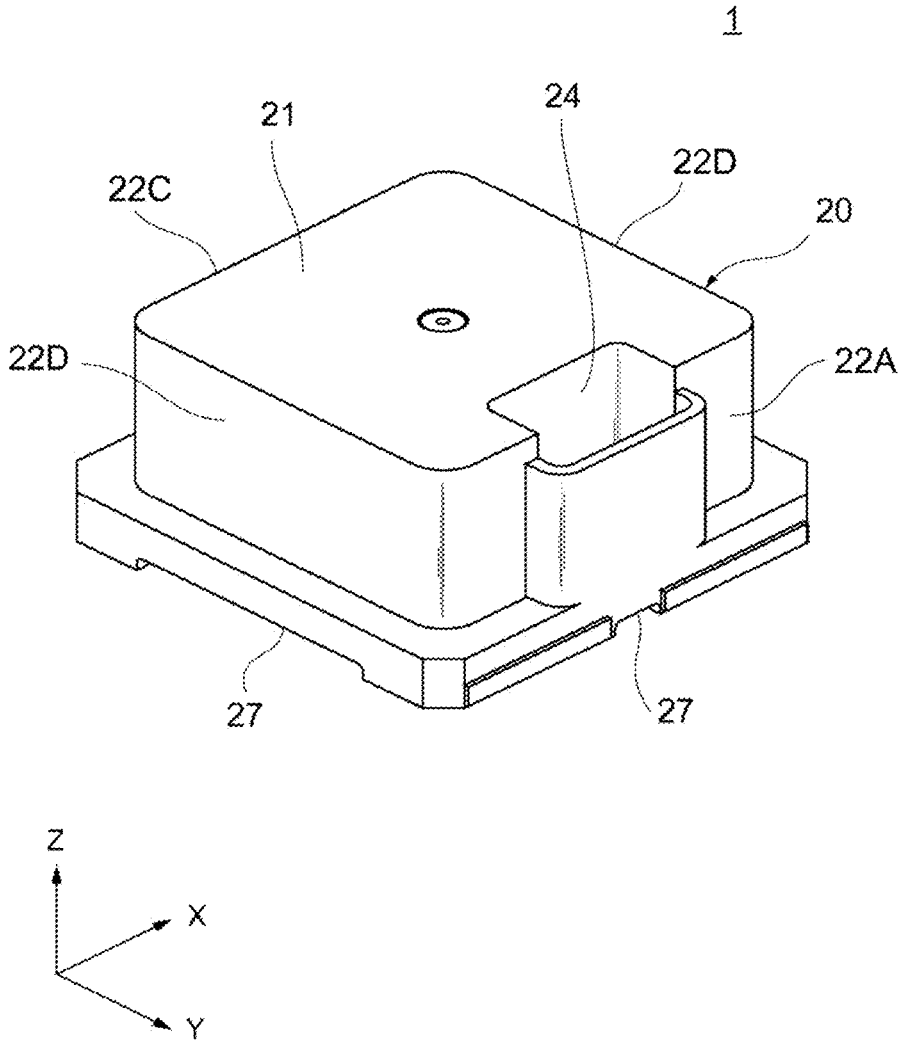
FIG. 1 is a perspective view that schematically illustrates a structure of a piezoelectric sounding component according to an embodiment of the invention.
Figure 2:
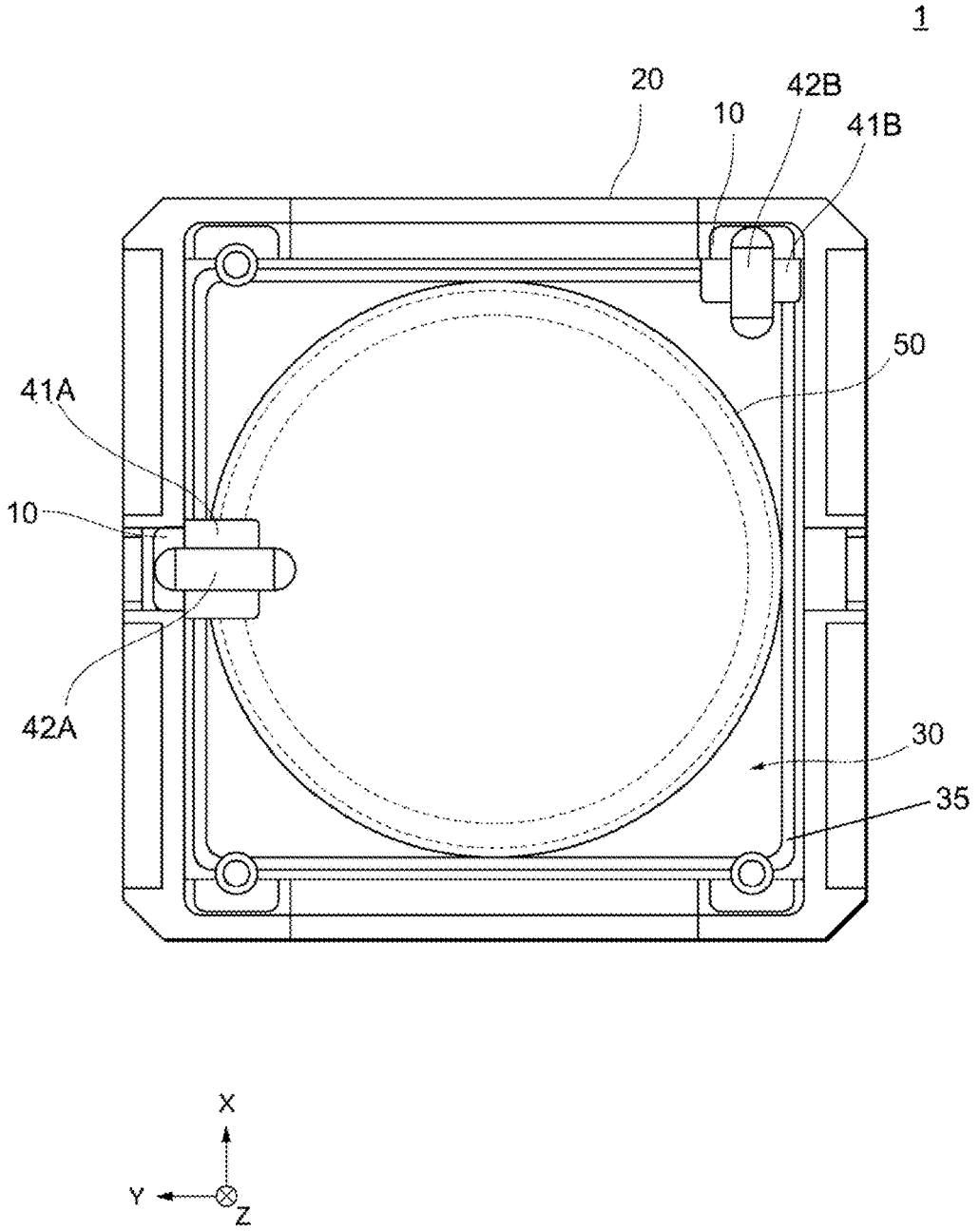
FIG. 2 is a plan view that schematically illustrates a structure of a piezoelectric sounding component according to an embodiment of the invention.
Figure 3:
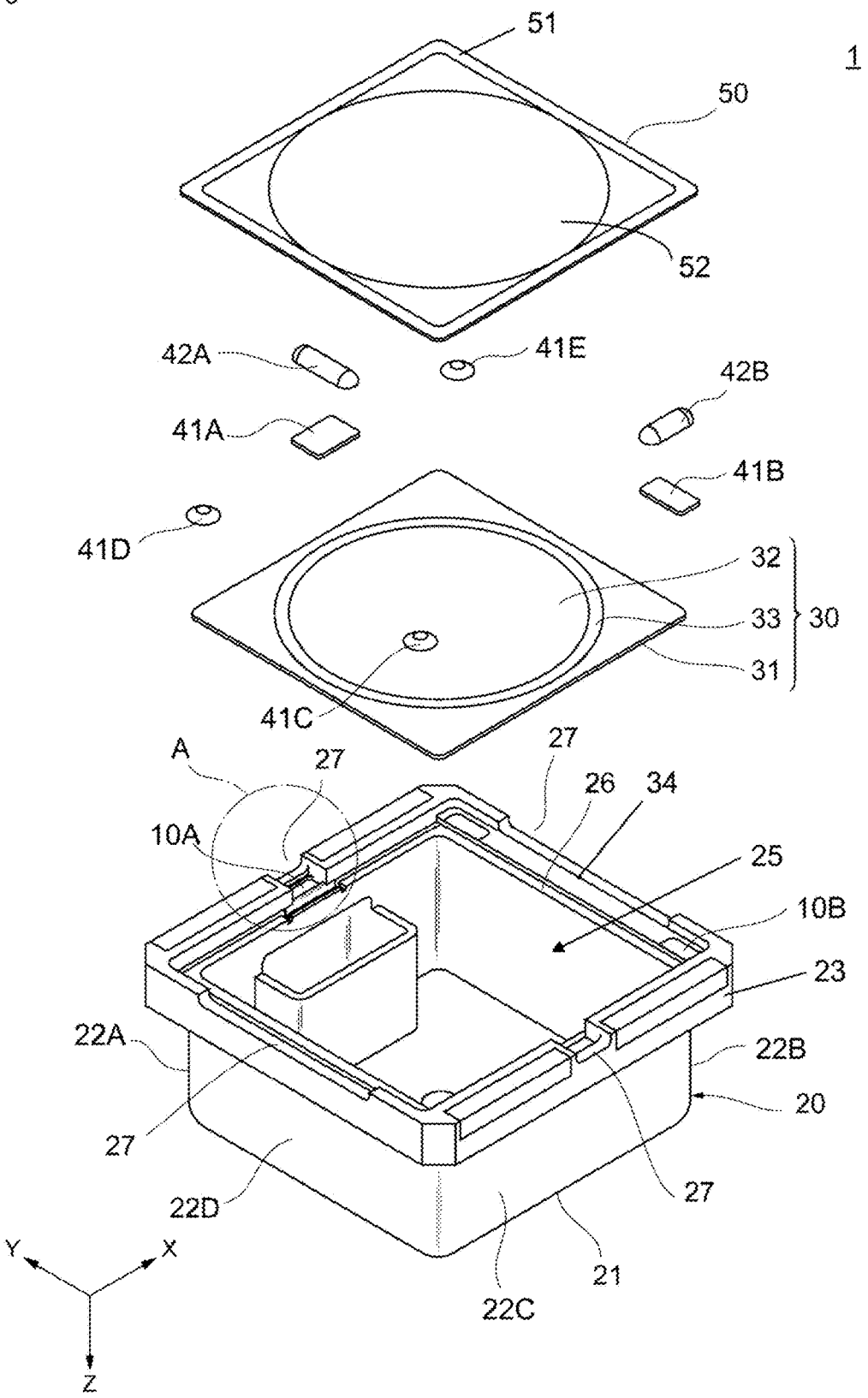
FIG. 3 is an exploded perspective view that schematically illustrates a structure of a piezoelectric sounding component according to an embodiment of the invention.

FIG. 1 is a perspective view that schematically illustrates a structure of a piezoelectric sounding component 1 according to an embodiment of the invention. FIG. 2 is a bottom plan view of the piezoelectric sounding component 1 of FIG. 1 (i.e., shown at an orientation rotated 180° from the orientation shown in FIG. 1). FIG. 3 is an exploded perspective view that schematically illustrates a structure of the piezoelectric sounding component in an orientation which is rotated 180° relative to the orientation shown in FIG. 1. Although FIGS. 1 to 3 illustrate components that are useful in describing at least some of the features in the structure of the piezoelectric sounding component 1, other components which are not shown in the figures can also be included (and shown features can be omitted).

(1. Structure)

As illustrated in FIGS. 1 to 3, the piezoelectric sounding component 1 includes a casing 20, a diaphragm 30, and a coating portion 50. The piezoelectric sounding component 1 further includes elastic insulating adhesives 41A-41E (cumulatively referred to hereinafter as elastic insulating adhesives 41) and conductive adhesives 42A and 42B (cumulatively referred to hereafter as conductive adhesives 42), and a coating portion 50. The piezoelectric sounding component 1 produces a sound when the diaphragm 30 bends and vibrates as voltage is applied to terminals 10 (described in further detail below).

(1-1. Diaphragm)

The diaphragm 30 includes a metal plate 31, which is shaped like a rectangular flat plate, and a piezoelectric body 33, which is formed on the metal plate 31 and is shaped like a circular flat plate.

The metal plate 31 is made from a material that has favorable conductivity and spring elasticity, such as a modulus of elasticity of 1 GPa or more, and specifically, is preferably made from a 42 alloy, stainless steel (SUS), brass, phosphor bronze, or the like. For example, the metal plate 31 may be a flat plate of a square whose sides are approximately 14.6 mm and whose thickness is approximately 0.08 mm. The plate 31 may be from a resin-based material, such as a glass epoxy substrate, only when the modulus of elasticity is 1 GPa or more. The metal plate 31 is not limited to a rectangular shape but may have a circular shape or a polygonal shape.

In the present embodiment, the piezoelectric body 33 is a circular plate that is preferably made from piezoelectric ceramics, such as PZT, and, by way of example, has a radius of approximately 13.6 mm and a thickness (in the Z axis direction) of approximately 0.055 mm. The piezoelectric body 33 is not limited to a circular shape but may, for example, have an oval shape or a polygonal shape. The thickness of the piezoelectric body 33 can be, for example, set to approximately 20 μm or more and to a few hundred μm or less according to desired characteristics.

A pair of electrodes 32 (only one of which is visible in the figures) are provided on opposite principal surfaces of the piezoelectric body 33 and are preferably smaller in diameter than the piezoelectric body 33. The electrodes 32 can be, for example, an Ag baked electrode with a thickness of approximately 1 μm, a NiCu (nickel-copper) alloy with a thickness of approximately 0.2 to 0.4 μm, or an Ag (silver) sputtering electrode is used.

In this embodiment, the diaphragm 30 is accommodated in the casing 20 so that peripheral edge portions of the diaphragm 30 are placed on a support portion 26 of the casing (described below) with the piezoelectric body 33 being located above the metal plate (as viewed in FIG. 3). The diaphragm 30 has a structure where the piezoelectric body 33 is formed on only part of the metal plate 31. However, the invention is not so limited. For example, the piezoelectric body 33 may be formed on the entire upper surface of the metal plate 31 (again, as viewed in FIG. 3). In addition, the diaphragm 30 may be mounted in the casing 20 in an orientation where the piezoelectric body 33 is on the bottom principal surface of the metal plate 31 and faces the bottom wall 21 of the casing 20. For still another example, the diaphragm 30 may have a structure where a respective piezoelectric body 33 is formed on opposite sides of the metal plate 31.

(1-2. Casing)

The casing 20 includes a box shaped sound chamber 25 and a frame 23. The sound chamber 25 is defined by a flat bottom wall 21 lying in an XY plane and four side walls 22A-22D (cumulatively referred to hereinafter as side walls 22) extending (upwardly as viewed in FIG. 3 and downwardly as viewed in FIG. 1) at a 90 degree angle relative to the XY plane in which the bottom wall 21 lies. The frame 23 extends (upwardly as viewed in FIG. 3, downwardly as viewed in FIG. 1) from the distal edges of the side walls 20 and together with the upper surfaces of side walls 22 define, inter alia, a support portion 26 on which the diaphragm 30 is supported, a ledge 34 on which the terminals 10 are formed and a mounting surface 28 (the topmost surface as viewed in FIG. 3 and the bottommost surface as viewed in FIG. 1) which is typically mounted on a mounting substrate such as a circuit board (not shown). The casing is preferably made of an insulative material, such as ceramics or resin. When the casing 20 is formed of resin, it is preferable to use liquid crystal polymer (LCP), syndiotactic polystyrene (SPS), polyphenylene sulfide (PPS), polybutylene terephthalate (PBT), or the like. The casing 20 is not limited to an approximately squared box shape but may, for example, be shaped like a cylinder or a poligonal prism.

The bottom wall 21 is a flat plate lying along an XY plane. A sound releasing hole 24 is formed in the bottom wall 21 and permits a sound produced by the vibration of the diaphragm 30 to propagate outside of the casing 20. In the present embodiment, a depression with a thickness of approximately 1 mm is formed around the sound releasing hole 24.

The frame 23 is continuous with the upper surfaces of the side walls 22 and extends outwardly and upwardly therefrom (as viewed in FIG. 3). The upper ends of the side walls 22 which supports the diaphragm 30 at a position which closes the open sound chamber 25 and situates the diaphragm 30 at a position located below (as viewed in FIG. 3) the mounting surface 28 such that a space is formed between the upper surface of the diaphragm 30 and the mounting surface 28. One or more slit-like holes 27 are formed in the frame 23 and extend from the space between the upper surface of the diaphragm 30 and the mounting surface 28 and the outside of the casing 20 so as to reduce air resistance in the space.

Due to the presence and location of the sound releasing hole 24 and the slit-like holes 27, and the location of both the sound chamber 25 and the space between the diaphragm 30 and the mounting surface 28, the piezoelectric sounding component 1 can function as a Helmholtz resonator that enhances sound pressure of a specific frequency. The frequency can be adjusted by adjusting the volume of the sound chamber 25 and the predetermined space and the number, size and location of the slit-like holes 27 and the sound releasing hole 24.

The particular dimensions of the casing 20 are not limited but may be, for example, approximately 18 mm in length along the X axis direction, approximately 18 mm in length along the Y axis direction, and approximately 8 mm in thickness along the Z axis direction. The sound releasing hole 24 can, for example, have a length along the X axis direction of approximately 5 mm, a length along the Y axis direction of approximately 3.5 mm, and a thickness along the Z axis direction of approximately 3 mm.

(1-3. Terminals)

The terminals 10A and 10B are preferably located on two adjoining sides of the frame 23. Specifically, terminal 10A is formed at approximately the center of the side wall 22A and terminal 10B is formed near an end portion of the side wall 22B which is adjacent the side wall 22C. The terminals 10A and 10B are preferably formed on respective portions of the ledge 34 to couple the inside and outside of the casing 20 into conduction. The terminals 10 are made, for example, by plating with nickel (Ni), copper (Cu), or gold (Au) on iron, brass, or the like. In the present embodiment, the terminals 10 are preferably made of brass (S2680-1/2H), a nickel (Ni) primary coating of 1 μm, and a gold (Au) plating of approximately 0.02 μm or more and 0.1 μm or less. The terminals 10 are not limited to the structure where the terminals 10 are formed on two adjacent sides of the frame 23. For example, the terminals 10 may be formed on only one side of the frame 23.

(2. Adhesion Structure and Method)

The diaphragm 30 is affixed to the support portion 26 at positions adjacent the terminals 10A and 10B by elastic insulating adhesives 41A and 41B, respectively. Elastic insulating adhesive 41B couples one corner of diaphragm 30 to the support portion 26. The remaining three corners of the diaphragm 30 are coupled to the support portion by respective elastic insulating adhesives 41C-41E. Elastic insulating adhesive 41A extends from the diaphragm 30 over the recessed portion 29A (FIG. 4) of the support portion 26 located adjacent the terminal 20A. The elastic insulating adhesive 41 is preferably lower in elasticity than the conductive adhesive 42 described below and the material thereof is for example, a urethane-based adhesive with a modulus of elasticity that is approximately 3.7 MPa or the like.

Further, as best shown in FIG. 2, the conductive adhesives 42A and 42B extend over elastic insulating adhesives 41A and 41B from the diaphragm 30 to the casing 20 so as to lie across the elastic insulating adhesives 41A and 41B such that the diaphragm 30 (and more particularly the piezoelectric body 33) is electrically connected to the terminals 10A and 10B.

The conductive adhesive 42A is formed at or near the center of the side of the diaphragm 30 that faces the side wall 22A. More particularly, the conductive adhesive 42A extends from the diaphragm 31 to the terminal 10A and across the elastic insulating adhesive 41A formed on the recessed portion 29A (FIG. 4) in the support portion 26. In the present embodiment, the piezoelectric body 32 has a shape of a circular plate and is formed in the vicinity of the center of the metal plate 31. Accordingly, the side of the diaphragm 30 that faces the side wall 22A is closest to the piezoelectric body 33 in the vicinity of the center of the side. Thus, forming the conductive adhesive 42A in the vicinity of the center of the side wall 22A enables the terminal 10A and the piezoelectric body 33 to be connected through the conductive adhesive 42A short in dimension.

The conductive adhesive 42B is formed at or near an end portion of the side of the diaphragm 30 facing side wall 22B. More particularly, it is located near or adjacent the side wall 22C.

The conductive adhesives 42A and 42B preferably extend over the center of their associated elastic insulating adhesive 41A and 42B so as not to stick to the peripheries of their associated elastic adhesives. An example of the material of the conductive adhesive 42 is a urethane-based conductive adhesive with a modulus of elasticity of approximately 0.3 Gpa.

As best shown in FIG. 2, there is a gap 35 between the inside edges of the casing 20 and the outside peripheral edges of the diaphragm 30. The gap 35 is sealed by the coating portion 50 which, in this example, is formed in the shape of a square frame. In this embodiment, the coating portion 50 covers the entire upper surface (as viewed in FIG. 3) of the diaphragm 30 and includes a sealing portion 51, which seals the gap 35, and a protecting portion 52 which covers the exposed upper surface of piezoelectric body 32. This enables the piezoelectric body 33 to be protected even in a structure where the piezoelectric sounding component 1 includes no lid on the mounting surface side. Accordingly, the number of members that constitute the piezoelectric sounding component 1 can be reduced. Although the coating portion 50 preferably covers the entire upper surface of the diaphragm 30, the coating portion 50 may cover at least the piezoelectric body 33. In this case, the protecting portion 52 of the coating portion 50 preferably has a shape similar to that of the piezoelectric body 33. For instance, in the example of FIG. 3, the protecting portion 52 has a shape of a circular plate and is in contact with the sealing portion 51 on an extension of the diameter. Further, the protecting portion 52 may have a structure where all of the edge portions thereof are in contact with the sealing portion 51.

The coating portion 50 preferably has a thickness of 500 μm or less so as to reduce inhibition on vibration of the diaphragm 30. The coating portion 50 can be made, for example, of silicone, epoxy low in elasticity, fluororesin, or the like. When silicone is used for the coating portion 50, the percentage of content of low molecular siloxane is preferably 100 ppm or less. Thus, an insulation fault of ambient electronic components caused by the siloxane separating from the silicone can be inhibited.

(3. Recessed Portion)

The structure of the recessed portion 29A is described in detail next with respect to FIGS. 4 and 5. The recessed portion 29A is formed in the support portion 26 of the side wall 22B. The recessed portion 29A is preferably a groove formed in the support portion 26 so as to release air confined between the support portion 26 and the diaphragm 30 when the elastic insulating adhesive 41 extends from the diaphragm 30 to the casing 20. The recessed portion 29A is formed in the support portion 26 at least in a position where the conductive adhesive 42A is coated such that the recessed portion 29A is at least partially covered with the elastic insulating adhesive 41A on which the conductive adhesive 42A is coated. Preferably, the elastic insulating adhesive 41A, the conductive adhesive 42A, and the sealing portion 51 of the coating portion 50 are laminated (stacked) in this order on at least part of the recessed portion 29A. The recessed portion 29A may also be formed in a portion of the support portion 26 where the conductive adhesive 42B is located.

In the present embodiment, the recessed portion 29A is preferably a groove with a bottom face that is located below the face of the support portion 26. The recessed portion 29A is formed along the inside edge of the side wall 22B along a region of the support portion 26 that faces the terminal 10. The recessed portion 29A is not limited to a groove but may be for example, a hole formed in the support portion 26. The recessed portion 29A may be uneven while being formed on a supporting face of the support portion 26.

Figure 4:
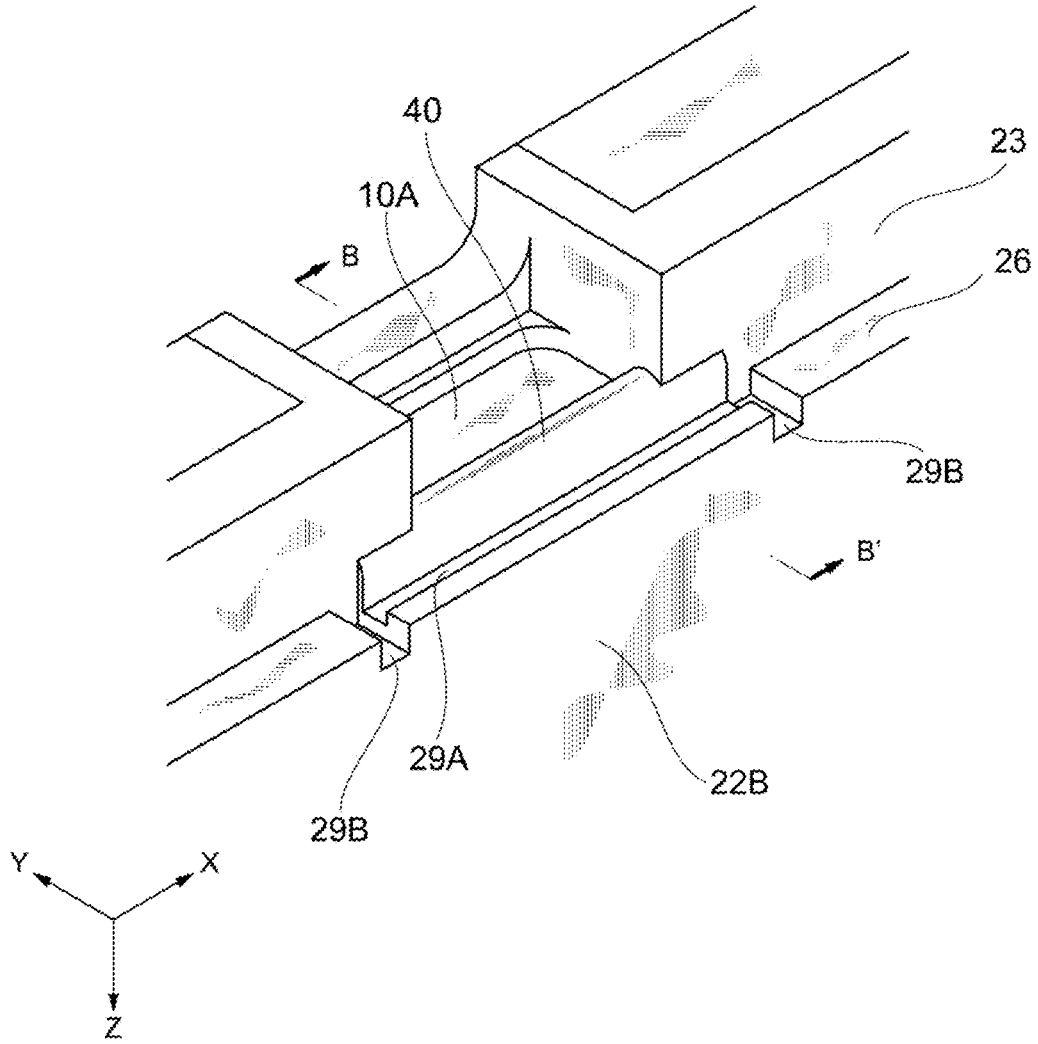
FIG. 4 illustrates an enlarged view of the region A in FIG. 3.

As shown in FIG. 4, the support portion 26 preferably includes a pair of grooves 29B which extend in a direction perpendicular to the side wall 22B (the Y axis direction) located at opposite ends of the recessed portion 29A. In a state where the coating portion 50 is not formed, the side grooves 29B allow fluid communication between the recessed portion 29A and space inside the sound chambers 25. The side grooves 29B may be omitted. In this case, even in a state where the coating portion 50 is not formed, the recessed portion 29A may be hermetically sealed by the elastic insulating adhesive 41A. A projecting portion 40 is preferably formed between the support portion 26 and the terminal 10A.

It is preferable that the volume of the recessed portion 29A is for example, 1% or more and 10% or less of the volume of the elastic insulating adhesive 41A located under the conductive adhesive 42A, which is for example, approximately 5% in the present embodiment.

The recessed portion 29A allows air confined between the support portion 26 and the diaphragm 30 to be released when the elastic insulating adhesive 41A is coated from the diaphragm 30 to the casing 20. As a result, when the conductive adhesive 42A is coated on the elastic insulating adhesive 41A, it is possible to avoid the creation of a bubble confined in the elastic insulating adhesive 41A. Consequently, the elastic insulating adhesive 41A can be more reliably coupled to the contact face of the conductive adhesive 42A and instability of conductive adhesive 42A can be avoided. This reduces the possibility that the connection between the conductive adhesive 42A, the diaphragm 30 and the terminal 10A will be broken and avoids a short circuit of the piezoelectric sounding component 1 caused by, for example, the conductive adhesive 42A coming into contact with the metal plate 31.

(4. Effect)

Figure 5:
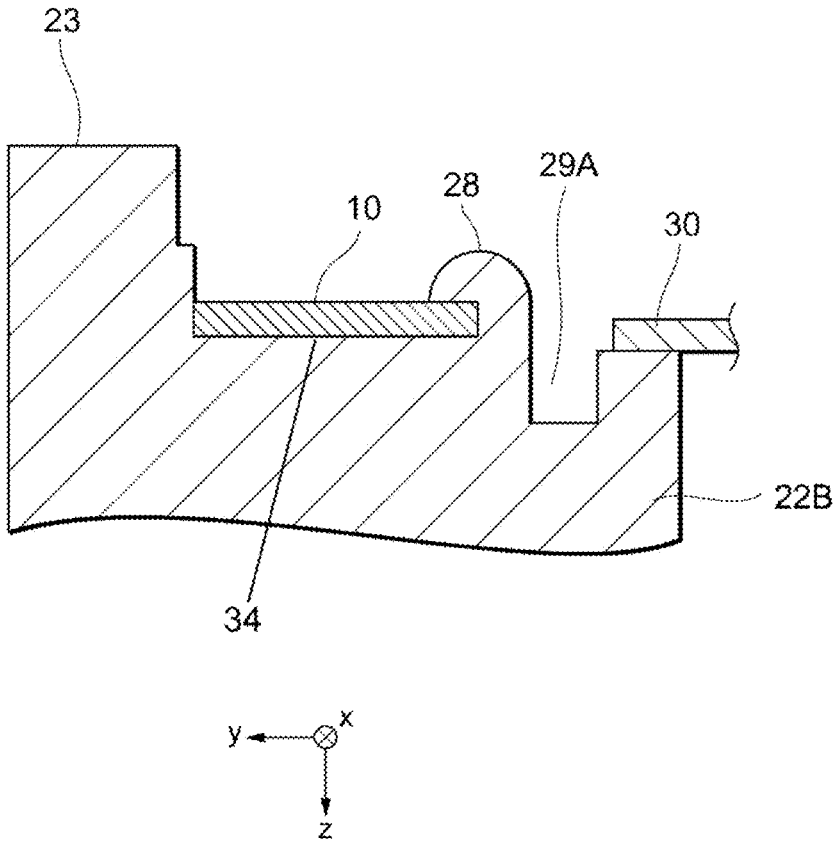
FIG. 5 is a cross-sectional view along BB' in FIG. 4.
Figure 6B:
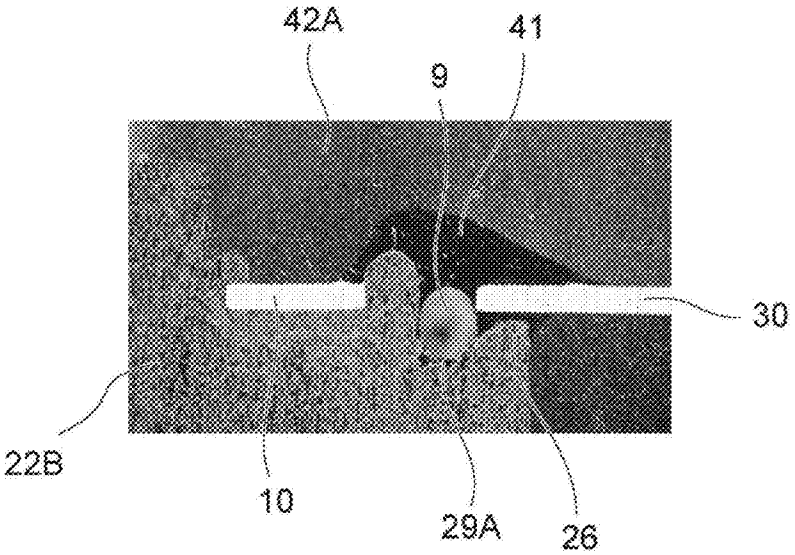
FIGS. 6A and 6B are pictures demonstrating the effect of a piezoelectric sounding component according to an embodiment of the invention.
Figure 6A:
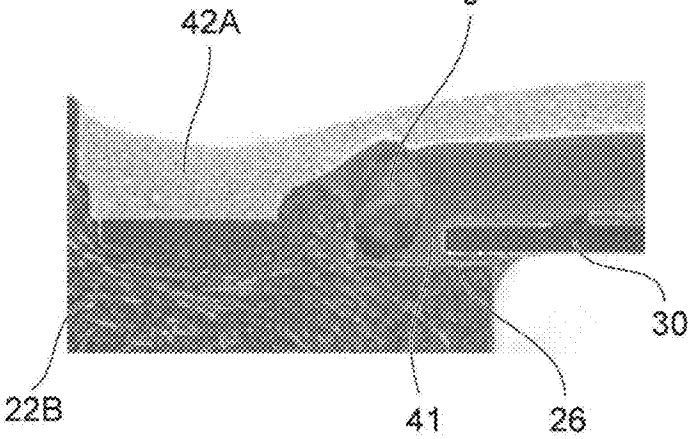

FIG. 6A is a pictorial cross section corresponding to FIG. 5 of a comparative example and FIG. 6B is a pictorial cross section corresponding to FIG. 5 of piezoelectric sounding components in accordance with the present invention.

As illustrated in FIG. 6(A), in the piezoelectric sounding component according to the comparative example, no recessed portion is formed in a support portion. Thus, a bubble 9 of air is captured in the elastic insulating adhesive 41A extending from the diaphragm 30 to the support portion 26. When the confined bubble 9 expands during a heating process or the like, it raises the upper surface of the elastic insulating adhesive 41A on which the conductive adhesive 42A lies. As a result, the conductive adhesive 42A can easily break.

In contrast, as illustrated in FIG. 6(B), in the piezoelectric sounding component 1 according to the present embodiment, the recessed portion 29A is formed in the support portion 26. This allows a bubble 9 to escape to the recessed portion 29A and avoid being confined in the elastic insulating adhesive 41A. As a result, the upper contact face of the elastic insulating adhesive 41A does not extend upward (or at least does not appreciably extend upward) and damage to the conductive adhesive 42A or its connection to the terminal 10A and/or the diaphragm 30 can be avoided.

As described above, in the piezoelectric sounding component 1 according to the present embodiment, a break of the conductive adhesive 42A can be inhibited and reliability of the electrical connection between the conductive adhesive 42 and the terminal 10A and the diaphragm 30 can be enhanced.

In the foregoing embodiments, the recessed portions 29A and 29B are located at a position facing terminal 10A. Similar recessed portions can be formed at positions facing the terminal 10B (and/or any other terminals in the casing 20) be enhanced by the support portion 26 including the recessed portion 29A.

It is preferable that the recessed portion 29A is a groove that is formed along an inside edge of the side wall 22 in a region included in the support portion 26 and facing the terminal 10. Further, it is preferable that the elastic insulating adhesive 41, the conductive adhesive 42, and the sealing portion 50 are sequentially formed in the recessed portion 29A.

Each of the above-described embodiments is intended to facilitate understanding of the present invention and is not intended to limit interpretation of the present invention. The present invention can be changed or modified without departing from its gist and the present invention includes equivalents thereof. That is, what is obtained by a person skilled in the art adding a design change to each embodiment when necessary is subsumed in the scope of the present invention as long as such a change includes the features of the present invention. For example, the elements in each embodiment and the arrangements, materials, conditions, shapes, sizes, and the like thereof are not limited to those exemplified but may be changed when necessary. Each embodiment is an example and, not to mention, partial replacements or combinations in structures described in different embodiments are possible and subsumed in the scope of the present invention as long as such partial replacements or combinations include the features of the present invention.

The invention claimed is:

1. A piezoelectric sounding component, comprising: a diaphragm which vibrates in response to an electric signal applied thereto; a casing having a sound chamber having an open end and a support portion for supporting the diaphragm at a location within the casing such that the diaphragm closes the open end of the sound chamber, the diaphragm being supported by the support portion such that there is a gap between outer peripheral edges of the diaphragm and inner surfaces of the casing; first and second terminals located on casing; first and second elastic adhesives that join the diaphragm to the casing at locations corresponding to the first and second terminals, respectively; first and second conductive adhesives extending over the first and second elastic adhesives, respectively, and electrically connecting the diaphragm to the first and second terminals, respectively; and a frame-like sealing portion that seals the gap between outer peripheral edges of the diaphragm and inner surfaces of the casing; wherein the support portion includes a recessed portion, at least part of which is located immediately below, and in direct contact with the first elastic adhesive.

2. The piezoelectric sounding component according to claim 1, wherein the recessed portion is a groove that is formed at a location corresponding to the first terminal.

3. The piezoelectric sounding component according to claim 2, wherein the location corresponding to the first terminal is a location facing the first terminal.

4. The piezoelectric sounding component according to claim 3, wherein the first elastic adhesive, the first conductive adhesive, and the sealing portion are located one on top of the other in that order.

5. The piezoelectric sounding component according to claim 2, wherein the first elastic adhesive, the first conductive adhesive, and the sealing portion are located one on top of the other in that order.

6. The piezoelectric sounding component according to claim 1, wherein the first elastic adhesive, the first conductive adhesive, and the sealing portion are located one on top of the other in that order.

7. The piezoelectric sounding component according to claim 1, wherein the diaphragm comprising a metal plate and a piezoelectric body coupled to the metal plate.

8. The piezoelectric sounding component according to claim 7, wherein the frame-like sealing portion also includes a portion covering the piezoelectric body.

9. The piezoelectric sounding component according to claim 1, wherein the casing includes a bottom wall and a plurality of side walls extending upwardly from the bottom wall, inner surfaces of the bottom wall and the plurality of side walls cooperating with to define the sound chamber.

10. The piezoelectric sounding component according to claim 9, wherein the support portion is defined by top surfaces of the side walls.

11. The piezoelectric sounding component according to claim 1, wherein the sound chamber takes the form of a rectangular parallelepiped.

12. The piezoelectric sounding component according to claim 1, wherein the recessed portion includes portions extending into the sound chamber so there is fluid communication between the recessed portion and the sound chamber.

13. The piezoelectric sounding component according to claim 1, wherein the casing further includes an upwardly projecting portion located between the first terminal and the recessed portion and extending above both the recessed portion and the first terminal.

14. The piezoelectric sounding component according to claim 13, wherein the recessed portion is a first recessed portion and the piezoelectric sounding component further comprises a second recessed portion, at least part of which is located immediately below the second elastic adhesive.

15. The piezoelectric sounding component according to claim 1, wherein a bubble of fluid is located between the recessed portion and a bottom surface of the first elastic adhesive.

16. The piezoelectric sounding component according to claim 1, wherein the recessed portion is a first recessed portion and the piezoelectric sounding component further comprises a second recessed portion, at least part of which is located immediately below the second elastic adhesive.

17. The piezoelectric sounding component according to claim 16, wherein the upward projecting portion is a first upward projecting portion and the casing further includes a second upwardly projecting portion located between the second terminal and the second recessed portion and extends above both the second recessed portion and the second terminal.

* * * * *